US011322878B2

(12) United States Patent
Miyamoto

(10) Patent No.: US 11,322,878 B2
(45) Date of Patent: May 3, 2022

(54) CONNECTOR

(71) Applicant: SUMITOMO WIRING SYSTEMS, LTD., Mie (JP)

(72) Inventor: Takeru Miyamoto, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/055,635

(22) PCT Filed: May 20, 2019

(86) PCT No.: PCT/JP2019/019849
§ 371 (c)(1),
(2) Date: Nov. 16, 2020

(87) PCT Pub. No.: WO2019/230468
PCT Pub. Date: Dec. 5, 2019

(65) Prior Publication Data

US 2021/0210889 A1 Jul. 8, 2021

(30) Foreign Application Priority Data

May 28, 2018 (JP) ..... JP2018-101268

(51) Int. Cl.
*H01R 13/50* (2006.01)
*H01R 9/24* (2006.01)
(Continued)

(52) U.S. Cl.
CPC ..... *H01R 13/50* (2013.01); *H01R 9/24* (2013.01); *H01R 13/405* (2013.01); *H01R 13/42* (2013.01);
(Continued)

(58) Field of Classification Search
CPC .. H01R 13/5219; H01R 11/12; H01R 13/207; H01R 13/405; H01R 13/512;
(Continued)

(56) References Cited

U.S. PATENT DOCUMENTS 7,264,506 B2 * 9/2007 Mori ..... H01R 11/03 439/606
7,306,475 B2 * 12/2007 Tsuruta ..... H01R 4/30 439/364
(Continued)

FOREIGN PATENT DOCUMENTS

JP 3160343 U 6/2010
JP 2013-016384 A 1/2013
(Continued)

OTHER PUBLICATIONS

International Search Report dated Jul. 30, 2019 for WO 2019/230468 A1 (3 pages).

*Primary Examiner* — Edwin A. Leon
*Assistant Examiner* — Matthew T Dzierzynski
(74) *Attorney, Agent, or Firm* — Abelman, Frayne & Schwab

(57) ABSTRACT

A connector is provided with a housing made of resin and including a first opening open upward, and a terminal made of conductive metal and partially embedded in the housing. The terminal includes a base end portion projecting forward from an inner wall on a rear surface side in the first opening of the housing, a connecting portion provided to extend forward and to be connected to a mating device, and a coupling portion coupling a front end part of the base end portion and a rear end part of the connecting portion. The base end portion and the connecting portion are disposed on different axes when viewed in a third direction orthogonal to an upward direction and a forward direction. A length L1 of the base end portion is equal to or longer than a length L2 between the base end portion and the connecting portion.

6 Claims, 4 Drawing Sheets

(51) Int. Cl.

| | |
|---|---|
| ***H01R 13/405*** | (2006.01) |
| ***H01R 13/42*** | (2006.01) |
| ***H01R 13/58*** | (2006.01) |
| ***H01R 13/621*** | (2006.01) |

(52) U.S. Cl.
CPC ..... *H01R 13/5845* (2013.01); *H01R 13/621* (2013.01)

(58) Field of Classification Search
CPC ..... H01R 13/5202; H01R 13/6581; H01R 2201/26; H01R 24/60; H01R 13/52
See application file for complete search history.

(56) References Cited

U.S. PATENT DOCUMENTS

| | | | | |
|---|---|---|---|---|
| 8,118,614 | B2 * | 2/2012 | Sawada | H01R 13/5202 439/589 |
| 9,331,440 | B2 * | 5/2016 | Yoshida | H01R 24/60 |
| 10,243,293 | B2 * | 3/2019 | Umemura | H01R 13/512 |
| 10,553,979 | B2 * | 2/2020 | Iida | H01R 13/56 |
| 2018/0366866 | A1 | 12/2018 | Yokotani et al. | |

FOREIGN PATENT DOCUMENTS

| | | | |
|---|---|---|---|
| JP | 2017-010640 | A | 1/2017 |
| JP | 2017-134969 | A | 8/2017 |

* cited by examiner

CONNECTOR

CROSS REFERENCE TO RELATED APPLICATIONS

This application is a national phase of PCT application No. PCT/JP2019/019849, filed on 20 May 2019, which claims priority from Japanese patent application No. 2018-101268, filed on 28 May 2018, all of which are incorporated herein by reference.

TECHNICAL FIELD

A technique disclosed by this specification relates to a connector.

BACKGROUND

A connector assembly described in Japanese Patent Laid-open Publication No. 2017-134969 (Patent Document 1 below) is, for example, known as an example of a conventional connector. This connector includes a housing having a working cylindrical portion formed into an elliptical shape somewhat elongated in a front-rear direction and a terminal partially embedded in the housing by insert molding. The terminal includes a projecting portion projecting forward from an inner wall of the working cylindrical portion, a coupling portion extending downward from the front end of the projecting portion and a connecting portion extending forward from a lower end part of the coupling portion. The connecting portion is formed with an insertion hole penetrating in a vertical direction, and a bolt is inserted into this insertion hole.

PRIOR ART DOCUMENT

Patent Document

SUMMARY OF THE INVENTION

Problems to be Solved

If the bolt is inserted into the insertion hole of the connecting portion of the terminal and fastened to a mating side, a stress is generated in an interface between the projecting portion of the terminal and the inner wall of the working cylindrical portion and a load is applied to the inner wall of the working cylindrical portion. Particularly, if the terminal of the connector is a large current terminal, a plate thickness of the terminal is larger than general terminals. Thus, the stress applied to the interface between the projecting portion of the terminal and the inner wall of the working cylindrical portion further increases.

Means to Solve the Problem

A connector disclosed in this specification is provided with a housing made of resin, the housing including an opening open in a first direction, and a terminal made of conductive metal, the terminal being partially embedded in the housing, wherein the terminal includes a base end portion projecting from a first inner wall in the opening of the housing in a second direction toward a second inner wall facing the first inner wall, a connecting portion provided to extend in the second direction, the connecting portion being connected to a mating device, and a coupling portion coupling an end part of the base end portion in the second direction and an end part of the connecting portion in a direction opposite to the second direction, the base end portion and the connecting portion are disposed on different axes when viewed in a third direction orthogonal to the first direction and the second direction, and an entire length of the base end portion is equal to or longer than a length in the first direction between the base end portion and the connecting portion.

Further, a connector disclosed in this specification is provided with a housing including an opening open in a first direction, and a terminal arranged in the housing, the terminal penetrating through an inner wall of the housing, wherein the terminal includes a base end portion having a part projecting from the inner wall in a second direction, the second direction being a penetrating direction of the terminal, a connecting portion provided to extend in the second direction, the connecting portion being separated from the base end portion by a predetermined distance in the first direction, the connecting portion being connected to a mating device, and a coupling portion electrically connecting the base end portion and the connecting portion, and a length in the second direction of the part of the base end portion projecting from the inner wall is equal to or longer than a length in the first direction of the coupling portion.

The connecting portion is slightly displaced in a fastening direction when being fastened and connected to the mating device, for example, by a bolt. The base end portion is also displaced in the fastening direction via the coupling portion, whereby a stress is applied to an interface between the base end portion and the inner wall of the housing. At this time, since the entire length of the base end portion is equal to or longer than the length in the first direction between the base end portion and the connecting portion, a displacement amount of the base end portion on the inner wall side of the housing is smaller than that of the connecting portion as compared to the case where the entire length of the base end portion is shorter than the length in the first direction between the base end portion and the connecting portion. In this way, the stress applied to the interface between the base end portion and the inner wall of the housing is reduced. Further, since the base end portion is more easily deflected and the stress applied to the connecting portion is dispersed in the entire base end portion due to the longer entire length of the base end portion, the stress applied to the interface between the base end portion and the inner wall of the housing is reduced.

Further, since the base end portion and the connecting portion are disposed on different axes when viewed in the third direction and coupled by the coupling portion, the terminal has a crank shape as a whole. In this way, a stress applied to the connecting portion is dispersed to each of the base end portion and the coupling portion. Thus, the stress applied to the interface between the base end portion and the inner wall of the housing is reduced. By forming the terminal into a crank shape in this way, the stress applied to the interface between the base end portion and the inner wall of the housing can be reduced in a limited space in the opening of the housing.

Further, the base end portion and the connecting portion may be disposed on different axes when viewed in the first direction.

Since the base end portion and the connecting portion are disposed on different axes when viewed in the first direction, a length of the coupling portion is longer as compared to a configuration in which the base end portion and the connecting portion are disposed on the same axis when viewed in the first direction. In this way, the displacement amount of the base end portion on the inner wall side of the housing becomes smaller than that of the connecting portion and the stress applied to the interface between the base end portion and the inner wall of the housing is reduced.

Further, the connecting portion may be plate-like, and a connection hole to be connected to the mating device may be provided to be open in a plate surface of the connecting portion.

By providing the connection hole in the connecting portion, the terminal can be fastened to the mating device by a bolt.

Further, the connection hole of the connecting portion may be provided at a position closer to the second inner wall than to the first inner wall.

Since the connection hole is provided at the position closer to the second inner wall than to the first inner wall, the position of the connection hole is more separated from the interface between the base end portion and the inner wall of the housing in a plan view and a path on the terminal from the connection hole to the interface between the base end portion and the inner wall of the housing becomes longer accordingly as compared to a configuration in which the connection hole is provided at a position near the first inner wall. In this way, the displacement amount of the base end portion on the inner wall side of the housing becomes smaller than that of the connecting portion and the stress applied to the interface between the base end portion and the inner wall of the housing is reduced.

Effect of the Invention

According to the connector disclosed in this specification, it is possible to reduce a stress applied to the interface between the inner wall of the housing and the base end portion of the terminal.

DETAILED DESCRIPTION TO EXECUTE THE INVENTION

Embodiment

Figure 1:
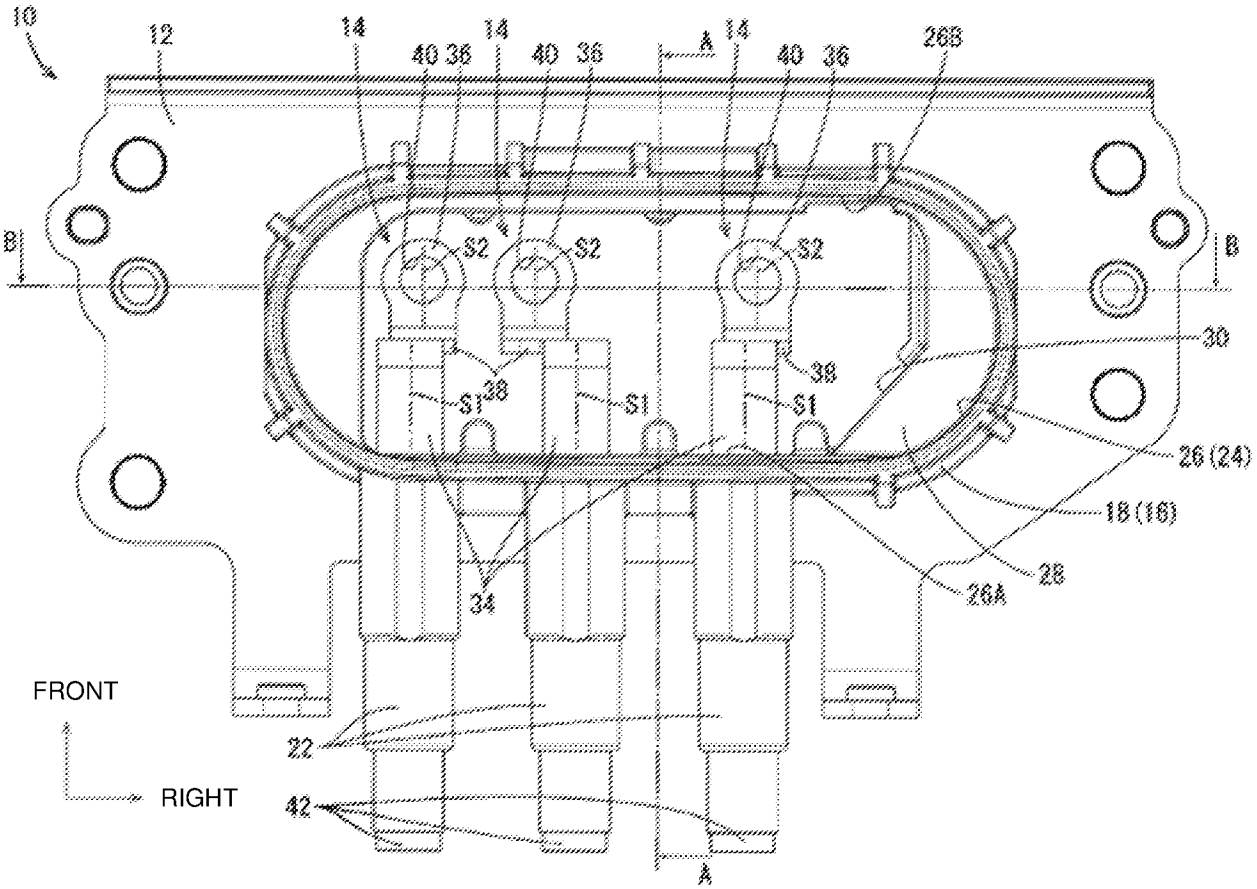
FIG. 1 is a plan view of a connector in an embodiment.

An embodiment is described with reference to FIGS. 1 to 4. A connector 10 of this embodiment is a connector to be connected to an inverter (hereinafter, referred to as a "mating device") of a vehicle and includes, as shown in FIG. 1, a mounting plate 12 to be mounted on a vehicle side, three terminals 14 made of conductive metal and to be connected to the mating device, and a housing 16 made of resin and integrally formed to the mounting plate 12 and the terminals 14. In the following description, an upward direction (first direction), a forward direction (second direction) and a rightward direction (third direction) are based on directions shown in FIGS. 1 to 4.

Figure 3:
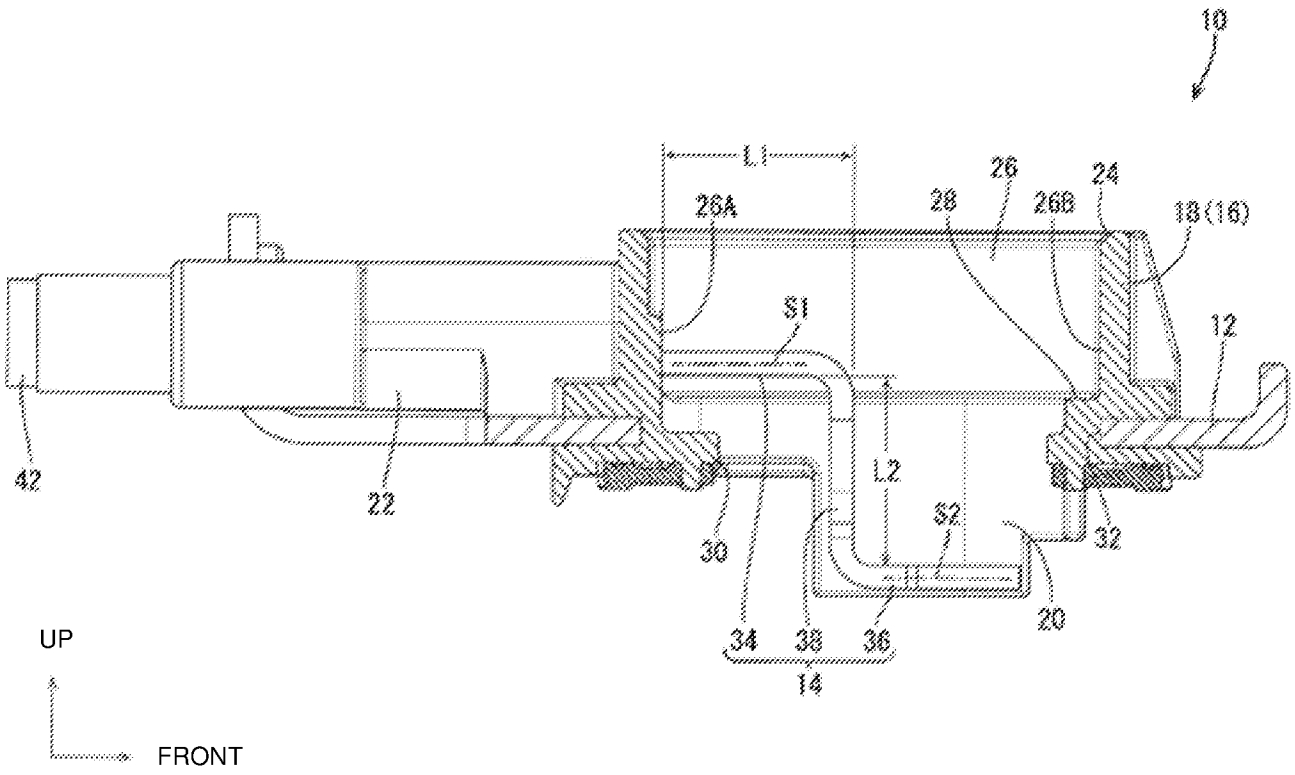
FIG. 3 is a section along A-A in FIG. 1.

As shown in FIG. 3, the housing 16 includes a tubular body portion 18, a pair of protection walls 20 and wire molding portions 22. As shown in FIG. 1, three wire molding portions 22 are provided. The body portion 18 is provided with a first opening (opening) 24 open upward, and the first opening 24 is provided to have an opening in the form of a long hole long in a lateral direction in a plan view as shown in FIG. 1. Further, a plate-like bottom wall 28 is provided in a bottom part of the body portion 18, and a second opening 30 is provided to be open in the bottom wall 28.

Figure 2:
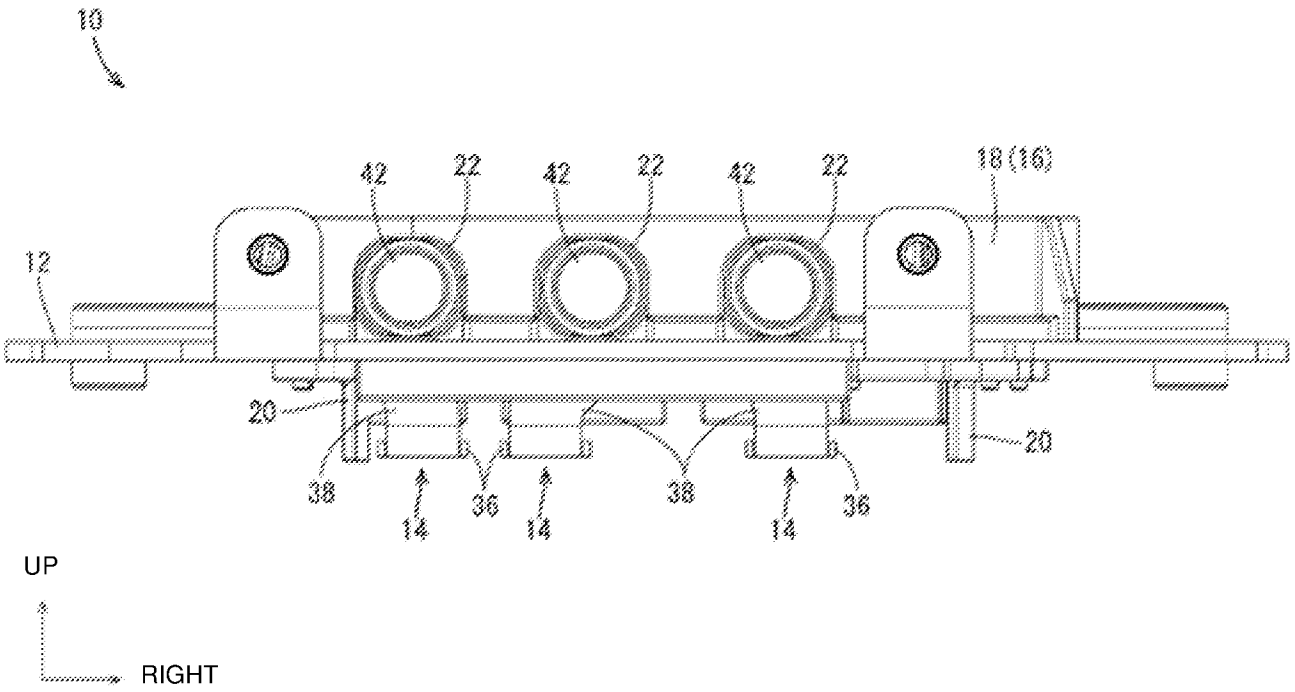
FIG. 2 is a front view of the connector.

As shown in FIG. 2, the pair of protection walls 20 are plate-like and respectively provided to project downward from both left and right opening edges of the second opening 30. As shown in FIG. 3, the protection walls 20 are provided at positions overlapping parts of the terminals 14 (parts of coupling portions 38 and connecting portions 36 to be described later) exposed downward from the second opening 30 of the body portion 18 when viewed from right. In this way, it is suppressed that a panel or the like of the vehicle laterally contacts the terminals 14 when the connector 10 is mounted.

The three wire molding portions 22 have a cylindrical shape long in the front-rear direction and are respectively provided to project rearward from the rear surface of the outer periphery of the body portion 18 as shown in FIGS. 1 and 2. The three wire molding portions 22 are disposed at predetermined intervals in the lateral direction.

The mounting plate 12 is in the form of a plate made of metal, and a mounting plate-side opening 32 is provided to be open in a plate surface of the mounting plate 12 as shown in FIG. 3. The opening edge of the mounting plate-side opening 32 of the mounting plate 12 is embedded in the body portion 18, whereby the body portion 18 is fixed to the mounting plate 12.

As shown in FIG. 3, the terminal 14 includes a plate-like base end portion 34 projecting from an inner wall 26A on a rear surface side of the body portion 18 in a direction toward an inner wall 26B on a front surface side facing the inner wall 26A on the rear surface side (i.e. forward), the plate-like connecting portion 36 long in the front-rear direction and to be connected to the mating device, and the plate-like coupling portion 38 coupling a front end part of the base end portion 34 and a rear end part of the connecting portion 36.

As shown in FIG. 1, the three terminals 14 are disposed at predetermined intervals in the lateral direction. Although not shown, a part of the terminal 14 behind the base end portion 34 serves as a wire connecting portion, and the wire connecting portion is embedded in the body portion 18. A core of a wire 42 extending in the front-rear direction is electrically connected to each of the wire connecting portions of the three terminals 14. Front end sides of the three wires 42 are respectively embedded in the three wire molding portions 22, whereby the three wires 42 are respectively held in the housing 16.

As shown in FIG. 3, an axis S1 of the base end portion 34 of the terminal 14 and an axis S2 of the connecting portion 36 are disposed on different axes when viewed from right, the axis S2 of the connecting portion 36 is located below the axis S1 of the base end portion 34, and the terminal 14 has a crank shape as a whole. Further, the front end part of the base end portion 34 and the rear end part of the connecting portion 36 are at the same position in the front-rear direction and the coupling portion 38 is orthogonal to the base end portion 34 and the connecting portion 36 as shown in FIG. 3.

As shown in FIG. 3, a length (entire length) L1 in the front-rear direction of the base end portion 34 is set equal to or longer than a vertical length L2 between the base end portion 34 and the connecting portion 36. In this embodiment, the length L1 is substantially equal to the length L2.

Figure 4:
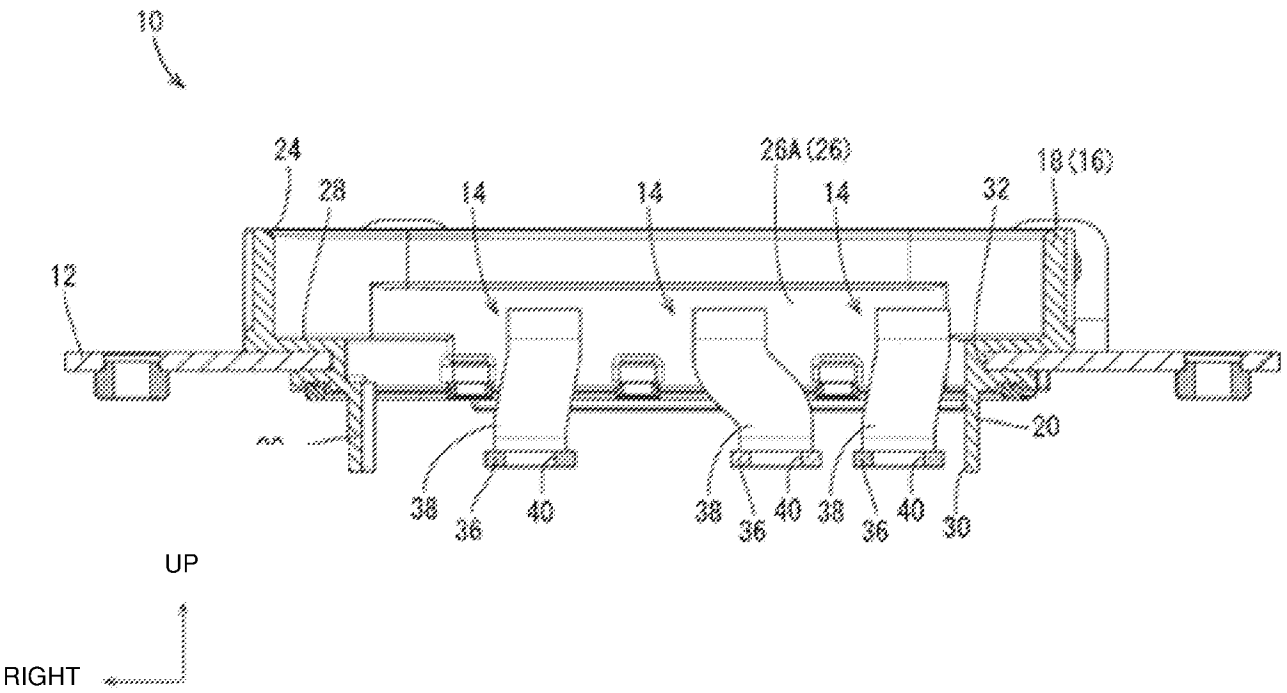
FIG. 4 is a section along B-B in FIG. 1.

As shown in FIG. 1, the axis S1 of the base end portion 34 of the terminal 14 and the axis S2 of the connecting portion 36 are disposed on different axes in a plan view. In this way, the coupling portion 38 is bent in the lateral direction as shown in FIG. 4.

As shown in FIG. 1, a connection hole 40 to be connected to the mating device is provided to be open in the plate surface of the connecting portion 36. The connection hole 40 is provided at a position closer to the inner wall 26B on the front surface side than to the inner wall 26A on the rear surface side of the body portion 18.

Next, functions of this embodiment are described.

If an unillustrated bolt is inserted into the connection hole 40 of the terminal 14 to connect the connecting portion 36 of the terminal 14 to the mating device, the connecting portion 36 of the terminal 14 is slightly displaced in a fastening direction (vertical direction) of the bolt. In this way, the base end portion 34 is also displaced in the vertical direction via the coupling portion 38. Further, a stress is applied to an interface between the base end portion 34 and the inner wall 26A of the body portion 18 due to a vertical displacement of the base end portion 34. At this time, since the length L1 of the base end portion 34 is substantially equal to the length L2, a displacement amount of the base end portion 34 on the side of the inner wall 26A is smaller than that of the connecting portion 36 as compared to the case where the length L1 of the base end portion 34 is shorter than the length L2. In this way, the stress applied to the interface between the base end portion 34 and the inner wall 26A is reduced. Further, since the length L1 of the base end portion 34 is substantially equal to the length L2, the base end portion 34 is more easily deflected and a stress applied to the connecting portion 36 is dispersed in the entire base end portion 34 as compared to the case where the length L1 is shorter than the length L. Thus, the stress applied to the interface between the base end portion 34 and the inner wall 26A is reduced.

Further, since the terminal 14 has a crank shape as a whole and a stress applied to the connecting portion 36 is dispersed to each of the base end portion 34 and the coupling portion 38, the stress applied to the interface between the base end portion 34 and the inner wall 26A is reduced. By forming the terminal into a crank shape in this way, the stress applied to the interface between the base end portion 34 and the inner wall 26A can be reduced in a limited space in the first opening 24 of the body portion 18.

Further, since the axis S1 of the base end portion 34 of the terminal 14 and the axis S2 of the connecting portion 36 are disposed on different axes in a plan view as shown in FIG. 1, the vertical length of the coupling portion 38 is longer as compared to a configuration in which the axis S1 of the base end portion 34 of the terminal 14 and the axis S2 of the connecting portion 36 are disposed on the same axis in a plan view. In this way, the displacement amount of the base end portion 34 on the side of the inner wall 26A is suppressed and the stress applied to the interface between the base end portion 34 and the inner wall 26A is reduced.

Further, since the connection hole 40 is provided at the position of the base end portion 34 closer to the inner wall 26B on the front surface side than to the inner wall 26A on the rear surface side, the position of the connection hole 40 is more separated from the interface between the base end portion 34 and the inner wall 26A in a plan view and a path on the terminal from the connection hole 40 to the interface between the base end portion 34 and the inner wall 26A on the rear surface side accordingly becomes longer as compared to a configuration in which the connection hole 40 is provided at a position near the inner wall 26A. In this way, the displacement amount of the base end portion 34 on the side of the inner wall 26A is suppressed and the stress applied to the interface between the base end portion 34 and the inner wall 26A is reduced.

As described above, according to this embodiment, the connecting portion 36 of the terminal 14 is slightly displaced in the fastening direction when being fastened and connected to the mating device, for example, by a bolt. The base end portion 34 is also displaced in the fastening direction via the coupling portion 38, whereby a stress is applied to the interface between the base end portion 34 and the inner wall 26A on the rear surface side (inner wall) of the housing 16. At this time, since the length (entire length) L1 of the base end portion 34 is equal to or longer than the length L2 in the first direction between the base end portion 34 and the connecting portion 36, a displacement amount of the base end portion 34 on the side of the inner wall 26A on the rear surface side (inner wall) of the housing 16 is smaller than that of the connecting portion 36 as compared to the case where the length (entire length) L1 of the base end portion 34 is shorter than the length L2 in the first direction between the base end portion 34 and the connecting portion 36. In this way, the stress applied to the interface between the base end portion 34 and the inner wall 26A on the rear surface side (inner wall) of the housing 16 is reduced. Further, since the base end portion 34 is more easily deflected and the stress applied to the connecting portion 36 is dispersed in the entire base end portion 34 due to the longer length (entire length) L1 of the base end portion 34, the stress applied to the interface between the base end portion 34 and the inner wall 26A on the rear surface side (inner wall) of the housing 16 is reduced.

Further, since the base end portion 34 and the connecting portion 36 are disposed on different axes when viewed from right and coupled by the coupling portion 38, the terminal 14 has a crank shape as a whole. In this way, a stress applied to the connecting portion 36 is dispersed to each of the base end portion 34 and the coupling portion 38. Thus, the stress applied to the interface between the base end portion 34 and the inner wall 26A on the rear surface side (inner wall) of the housing 16 is reduced. By forming the terminal 14 into a crank shape in this way, the stress applied to the interface between the base end portion 34 and the inner wall 26A on the rear surface side (inner wall) of the housing 16 can be reduced in the limited space in the first opening (opening) 24 of the housing 16.

Further, since the base end portion 34 and the connecting portion 36 are disposed on different axes when viewed in the first direction, the length of the coupling portion 38 is longer as compared to a configuration in which the base end portion 34 and the connecting portion 36 are disposed on the same axis when viewed in the first direction. In this way, the displacement amount of the base end portion 34 on the side of the inner wall 26A on the rear surface side (inner wall) of the housing 16 becomes smaller than that of the connecting portion 36 and the stress applied to the interface between the base end portion 34 and the inner wall 26A on the rear surface side (inner wall) of the housing 16 is reduced.

Further, the terminal 14 can be fastened to the mating device by the bolt by providing the connection hole 40 in the connecting portion 36.

Further, since the connection hole 40 is provided at the position closer to the inner wall (second inner wall) 26B on the front surface side than to the inner wall (first inner wall) 26A on the rear surface side, the position of the connection hole 40 is more separated from the interface between the base end portion 34 and the inner wall 26A on the rear surface side (inner wall) of the housing 16 in a plan view and the path on the terminal 14 from the connection hole 40 to the interface between the base end portion 34 and the inner wall 26A on the rear surface side (inner wall) of the housing 16 becomes longer accordingly as compared to a configuration in which the connection hole 40 is provided at a position near the inner wall (first inner wall) 26A on the rear surface side. In this way, the displacement amount of the base end portion 34 on the side of the inner wall 26A of the housing 16 becomes smaller than that of the connecting portion 36 and the stress applied to the interface between the base end portion 34 and the inner wall 26A on the rear surface side (inner wall) of the housing 16 is reduced.

Other Embodiments

The technique disclosed by this specification is not limited to the above described and illustrated embodiment. For example, the following various modes are also included.

(1) Although the length L1 of the base end portion 34 is substantially equal to the length L2 in this embodiment, the length L1 may be longer than the length L2.

(2) Although the axis S2 of the connecting portion 36 is located below the axis S1 of the base end portion 34 in this embodiment, the axis S2 may be located above the axis S1.

(3) Although the front end part of the base end portion 34 and the rear end part of the connecting portion 36 are at the same position in the front-rear direction in this embodiment, these end parts may be at different positions. For example, a rear end part of a connecting portion may be located behind a front end part of a base end portion and a terminal may have a Z shape as a whole. Further, a rear end part of a connecting portion may be located in front of a front end part of a base end portion and a coupling portion may be inclined downward from the front end part of the base end portion to the rear end part of the connecting portion.

(4) Although three terminals 14 are provided in this embodiment, two or less or four or more terminals may be provided.

(5) Note that, in this embodiment, the base end portion may be a part projecting from the first inner wall for the sake of convenience. Specifically, it goes without saying that the base end portion can be appropriately set in a range where a stress applied to an interface between the base end portion and the inner wall of the housing can be reduced.

LIST OF REFERENCE NUMERALS

10: connector
14: terminal
16: housing
24: first opening (opening)
26: inner wall
26A: inner wall on rear surface side (first inner wall)
26B: inner wall on front surface side (second inner wall)
34: base end portion
36: connecting portion
38: coupling portion
40: connection hole
S1: axis
S2 axis
L1: length
L2: length

What is claimed is:

1. A connector, comprising:

a housing made of resin, the housing including an opening open in a first direction; and a terminal made of conductive metal, the terminal being partially embedded in the housing, wherein:

the terminal includes:

a base end portion projecting from a first inner wall in the opening of the housing in a second direction toward a second inner wall facing the first inner wall;

a connecting portion provided to extend in the second direction, the connecting portion being connected to a mating device; and a coupling portion coupling an end part of the base end portion in the second direction and an end part of the connecting portion in a direction opposite to the second direction, the base end portion and the connecting portion are disposed on different axes when the terminal is viewed in a third direction orthogonal to the first direction and the second direction, an entire length of the base end portion is equal to or longer than a length in the first direction between the base end portion and the connecting portion, a first axis of the base end portion does not overlap a second axis of the connecting portion when the terminal is viewed in the first direction, and the first and second axes are parallel to the second direction.

2. The connector according to claim 1, wherein the base end portion and the connecting portion are disposed on different axes when the terminal is viewed in the first direction.

3. The connector according to claim 1, wherein the connecting portion is plate-like, and a connection hole to be connected to the mating device is provided to be open in a plate surface of the connecting portion.

4. The connector according to claim 3, wherein the connection hole of the connecting portion is provided at a position closer to the second inner wall than to the first inner wall.

5. The connector according to claim 1, wherein the first axis is disposed along a center of the base end portion, and the second axis is disposed along a center of the connecting portion.

6. A connector, comprising:

a housing including an opening open in a first direction; and a terminal arranged in the housing, the terminal penetrating through an inner wall of the housing, wherein:

the terminal includes:

a base end portion having a part projecting from the inner wall in a second direction, the second direction being a penetrating direction of the terminal, a connecting portion provided to extend in the second direction, the connecting portion being separated from the base end portion by a predetermined distance in the first direction, the connecting portion being connected to a mating device; and a coupling portion electrically connecting the base end portion and the connecting portion, a length in the second direction of the part of the base end portion projecting from the inner wall is equal to or longer than a length in the first direction of the coupling portion, a first axis of the base end portion does not overlap a second axis of the connecting portion when the terminal is viewed in the first direction, and the first and second axes are parallel to the second direction.

* * * * *